US005307900A

United States Patent [19]

Noga

[11] Patent Number: 5,307,900

[45] Date of Patent: May 3, 1994

[54] LADDER LEG EXTENSION APPARATUS

[76] Inventor: Leonard R. Noga, 1406 E. 12th St., Glencoe, Minn. 55336

[21] Appl. No.: 99,469

[22] Filed: Jul. 30, 1993

[51] Int. Cl.[5] ..... E06C 7/44

[52] U.S. Cl. ..... 182/204; 182/111

[58] Field of Search ..... 182/200-205, 182/107-111

[56] References Cited

U.S. PATENT DOCUMENTS

| | | | |
|---|---|---|---|
| 294,199 | 2/1884 | Cloyes | 182/204 |
| 970,425 | 9/1910 | Curran | 182/205 |
| 1,672,596 | 6/1928 | Zerk | 182/111 X |
| 3,165,170 | 1/1965 | Blaney | 182/203 |
| 4,671,383 | 6/1987 | Huang | 182/204 |
| 5,012,895 | 5/1991 | Santos | 182/204 |

FOREIGN PATENT DOCUMENTS

| | | | |
|---|---|---|---|
| 21621 | of 1895 | United Kingdom | 182/201 |
| 1150117 | 4/1969 | United Kingdom | 182/111 |

*Primary Examiner*—Alvin C. Chin-Shue
*Attorney, Agent, or Firm*—Leon Gilden

[57] ABSTRACT

A ladder extension leg apparatus is provided, wherein at least one of the first and second ladder legs includes a leg sleeve receiving the ladder leg to permit telescoping reception of the ladder leg to impart unequal effective length to the first and second legs to accommodate various uneven support heights to the ladder structure.

1 Claim, 5 Drawing Sheets

LADDER LEG EXTENSION APPARATUS

BACKGROUND OF THE INVENTION

1. Field of the Invention

The field of invention relates to ladder leg apparatus, and more particularly pertains to a new and improved ladder leg extension apparatus wherein the same permits the selective extension of one or a plurality of ladder legs relative to one another.

2. Description of the Prior Art

Ladder leg extension apparatus to accommodate various sloping terrain on uneven supports is provided in the prior art such as indicated in U.S. Pat. Nos. 4,091,893; 4,766,976; 5,027,923; and 5,064,024.

The instant invention attempts to overcome deficiencies of the prior art by providing for a ladder leg extension sleeve structure arranged for ease of use as well as effectiveness in construction and in this respect, the present invention substantially fulfills this need.

SUMMARY OF THE INVENTION

In view of the foregoing disadvantages inherent in the known types of ladder leg extension apparatus now present in the prior art, the present invention provides a ladder leg extension apparatus wherein the same is arranged to provide for a sleeve structure telescopingly receiving a ladder leg therewithin. As such, the general purpose of the present invention, which will be described subsequently in greater detail, is to provide a new and improved ladder leg extension apparatus which has all the advantages of the prior art ladder leg extension apparatus and none of the disadvantages.

To attain this, the present invention provides a ladder extension leg apparatus, wherein at least one of the first and second ladder legs includes a leg sleeve receiving the ladder leg to permit telescoping reception of the ladder leg to impart unequal effective length to the first and second legs to accommodate various uneven support heights to the ladder structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ladder leg extension apparatus which has all the advantages of the prior art ladder leg extension apparatus and none of the disadvantages.

It is another object of the present invention to provide a new and improved ladder leg extension apparatus which may be easily and efficiently manufactured and marketed.

It is a further object of the present invention to provide a new and improved ladder leg extension apparatus which is of a durable and reliable construction.

An even further object of the present invention is to provide a new and improved ladder leg extension apparatus which is susceptible of a low cost of manufacture with regard to both materials and labor, and which accordingly is then susceptible of low prices of sale to the consuming public, thereby making such ladder leg extension apparatus economically available to the buying public.

Still yet another object of the present invention is to provide a new and improved ladder leg extension apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
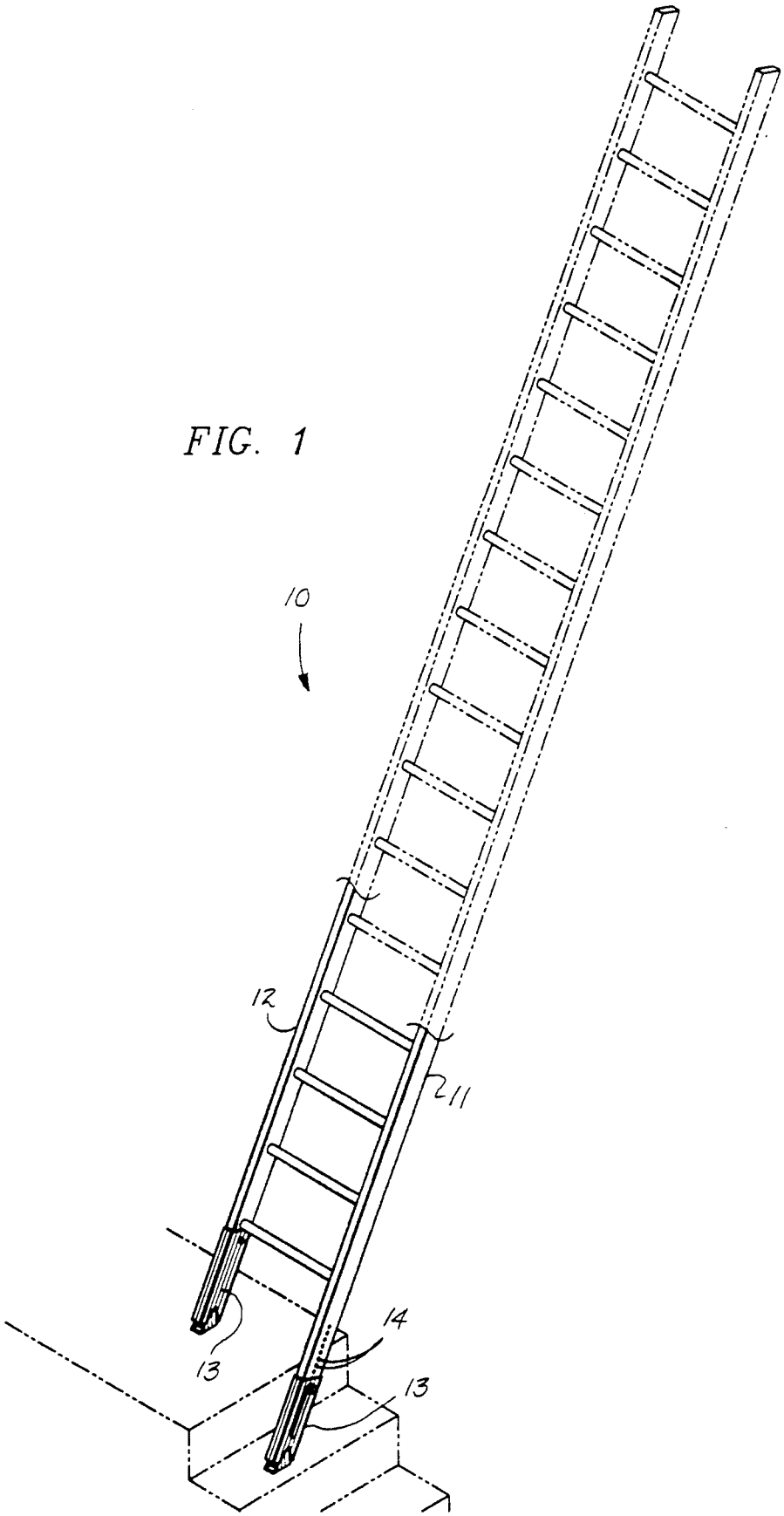
FIG. 1 is an isometric illustration of the invention.
Figure 2:
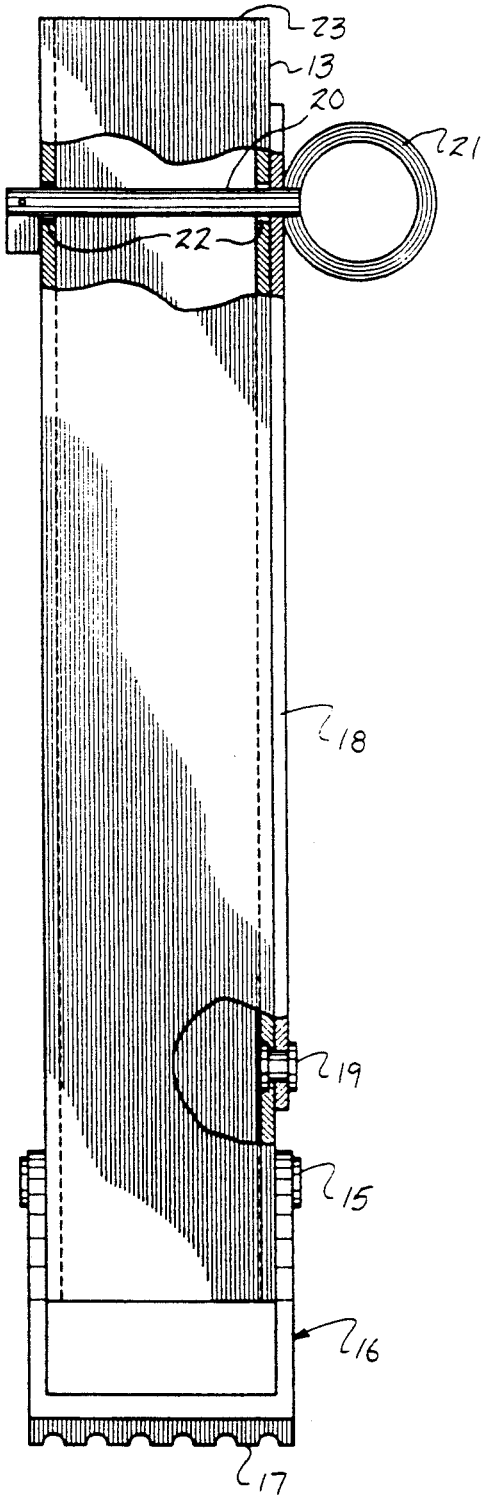
FIG. 2 is an orthographic end view of the invention.
Figure 3:
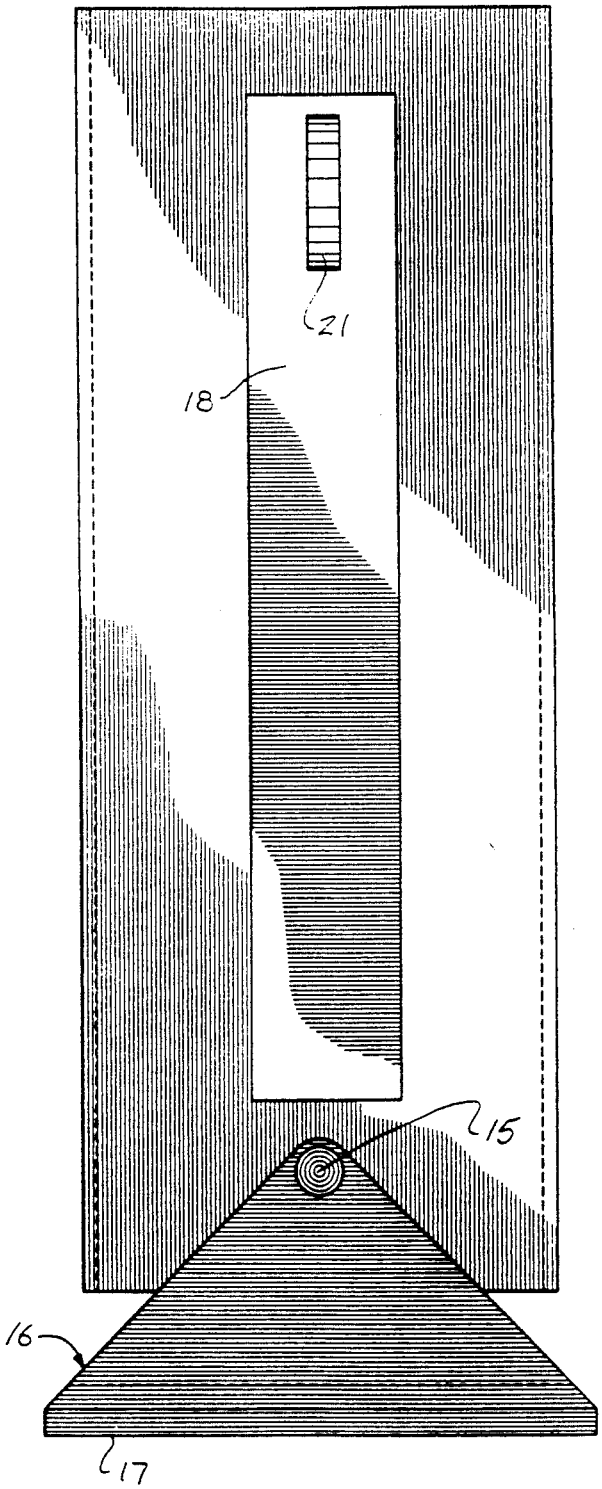
FIG. 3 is an orthographic side view of the sleeve structure.

With reference now to the drawings, and in particular to FIGS. 1 to 9 thereof, a new and improved ladder leg extension apparatus embodying the principles and concepts of the present invention and generally designated by the reference numeral 10 will be described.

More specifically, the ladder leg extension apparatus 10 of the instant invention essentially comprises a ladder, as indicated in FIG. 1, having respective first and second parallel legs 11 and 12 of equal length. At least one leg sleeve 13 is provided for each lowermost distal end of the first and second ladder legs 11 and 12 to receive the ladder legs therewithin in a telescoping relationship, such that each ladder leg includes a row of ladder leg apertures 14. The leg sleeve 13 includes a pivot axle 15 oriented near the bottom wall of the sleeve, such that the pivot axle pivotally mounts the foot member 16. A resilient bottom wall laminate 17 is mounted to a bottom wall of the foot member 16, with the laminate 17 having resilient projections to enhance frictional engagement with an underlying support surface. The leg sleeve 13 includes side walls, wherein at least one of the side walls includes a spring plate 18 having an anchor lug 19 mounting the spring plate 18 at a lowermost end of the spring plate in adjacency to the bottom wall of the leg sleeve 13. A lock pin 20 is fixedly mounted to the spring plate 18 at an uppermost end of the spring plate, with the lock pin 20 having a lock pin handle 21 permitting ease of manual grasping of the lock pin 20. The lock pin 20 is received through a plurality of coaxially aligned sleeve bores 22 directed through the side walls of the leg sleeve 13, with the lock pin 20 accordingly arranged to be received through the sleeve bores 22 and one of the aforenoted leg apertures 14 to accordingly receive the leg 11 or the leg 12 within a predetermined depth within the leg sleeve 13, as a respective ladder leg is received within an entrance 23 of the leg sleeve 13.

Figure 4:
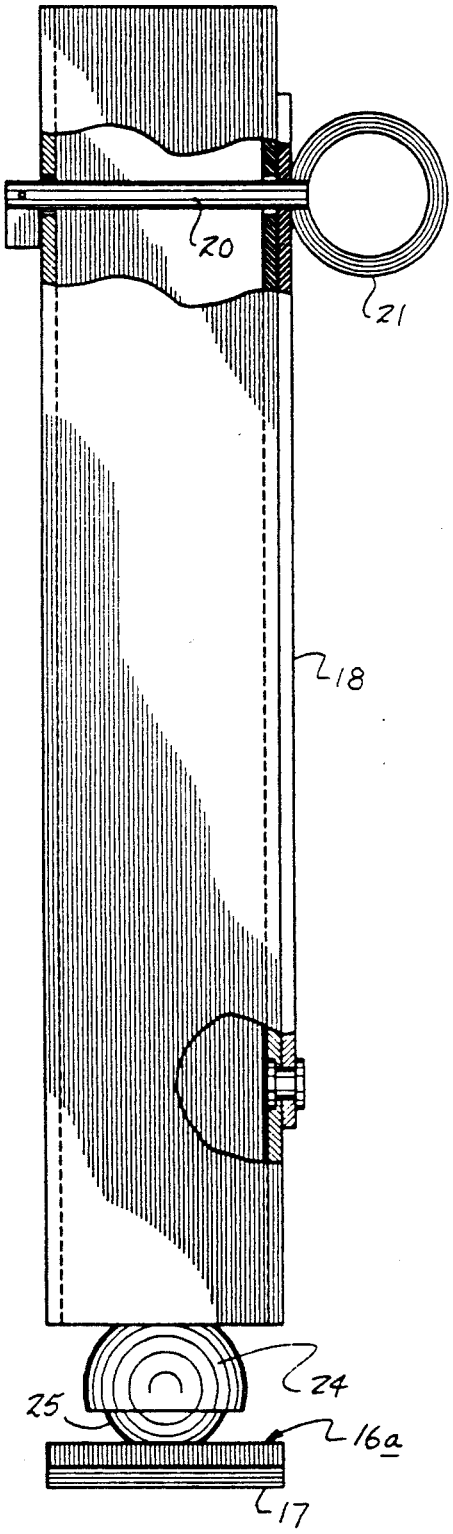
FIG. 4 is an orthographic end view of the sleeve structure including a pivotally mounted support foot.
Figure 5:
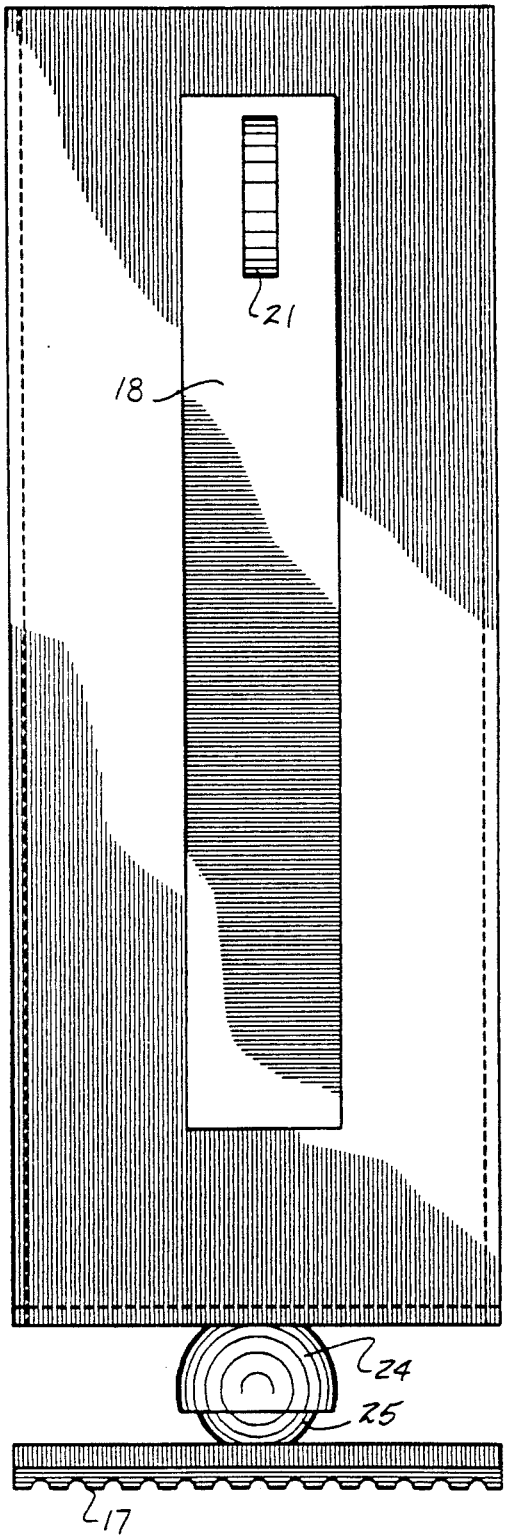
FIG. 5 is an orthographic side view of the invention, as indicated in FIG. 4.

The FIGS. 4 and 5 indicate the use of a spherical connector member 25 mounted to the floor of the leg sleeve, wherein the semi-spherical housing 24 includes a spherical connector member 25 rotatably mounted therewithin, wherein the spherical connector member 25 is received within the spherical housing and secured to a modified foot member **16*a*, having the resilient bottom wall laminate 17**.

Figure 6:
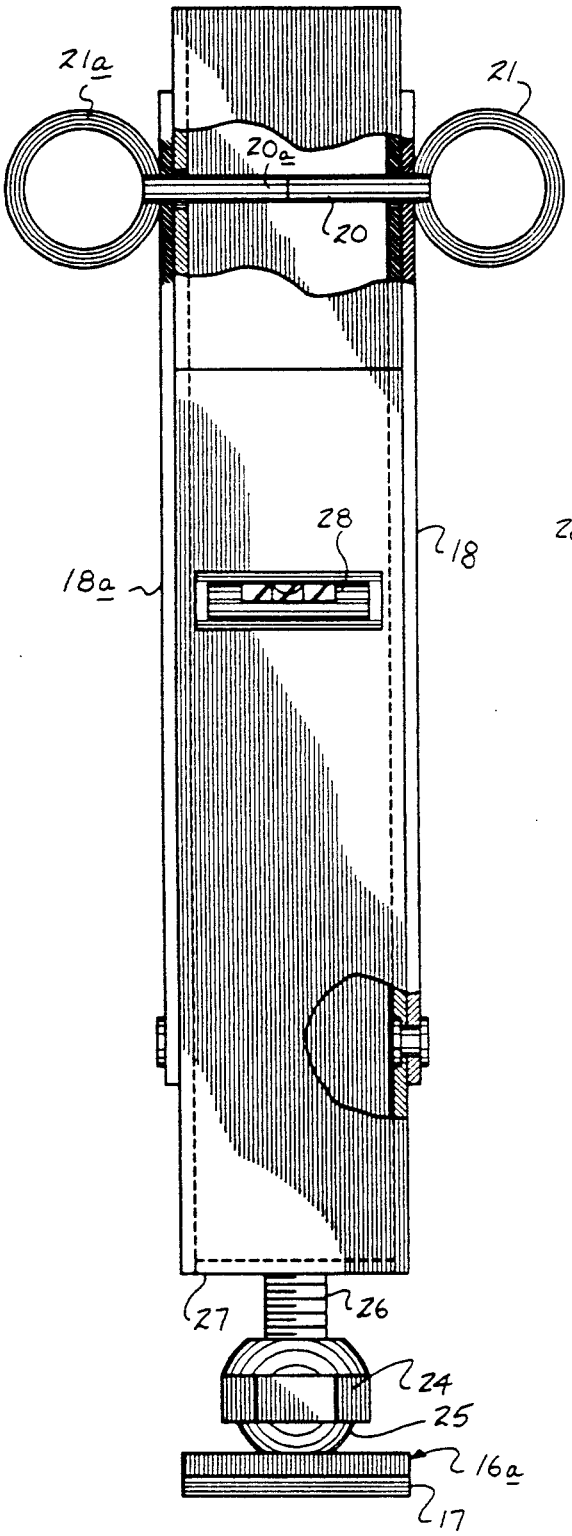
FIG. 6 is an orthographic end view of the sleeve structure employing a plurality of pins in cooperation with a spirit level.
Figure 7:
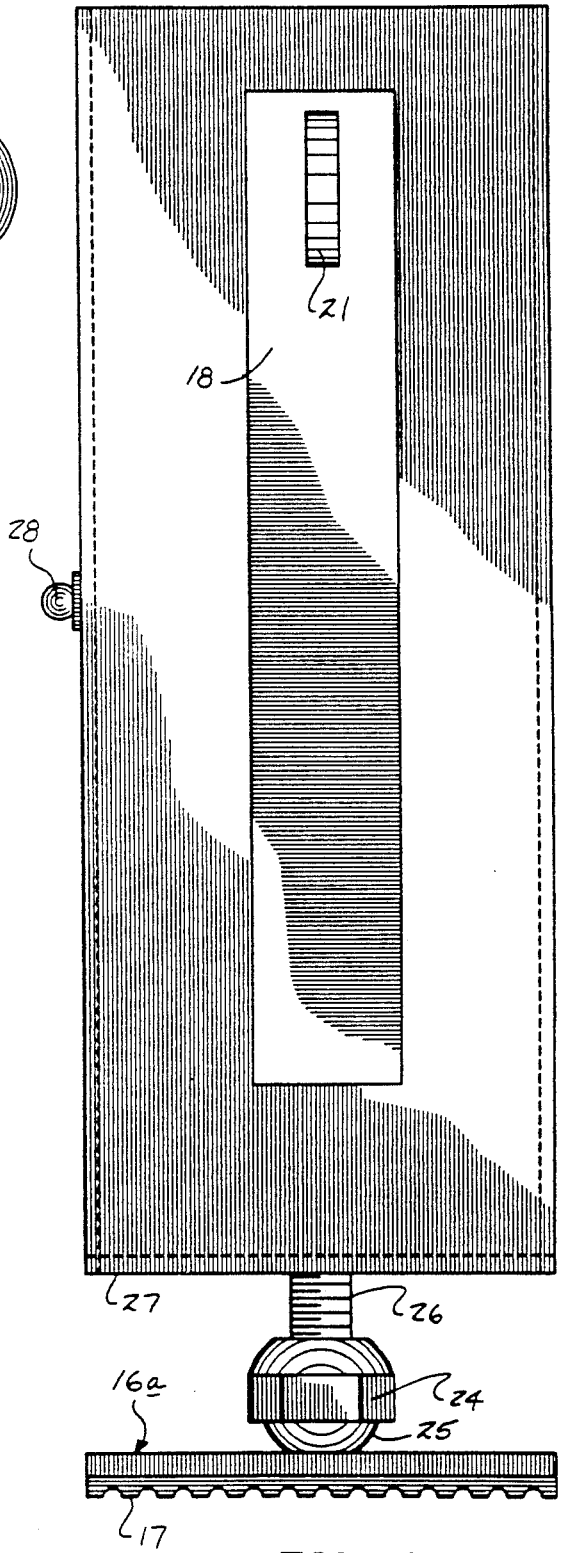
FIG. 7 is an orthographic side view of the invention, as indicated in FIG. 6.

The FIGS. 6 and 7 indicate the semi-spherical housing 24 further including a threaded adjuster rod 26 integrally mounted to the second spherical housing 24, with the threaded adjuster rod 26 received through the floor 27 of the sleeve 13. Further, a spirit level 28 is mounted to an end wall of the leg sleeve to provide for alignment of the leg sleeve as desired relative to a support surface.

Figure 8:
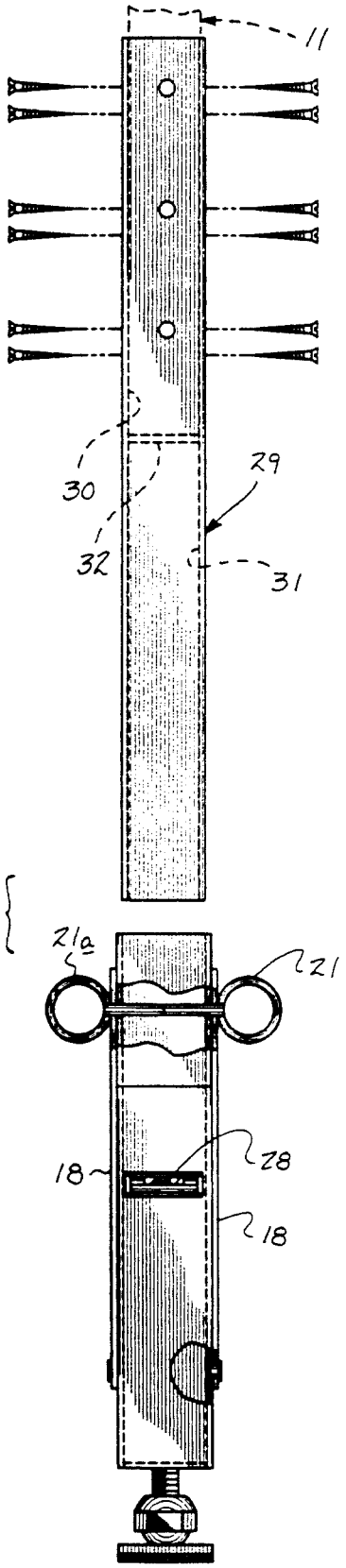
FIG. 8 is an orthographic end view of the sleeve structure, including a junction sleeve arranged to accommodate the ladder leg and for reception within the leg sleeve.
Figure 9:
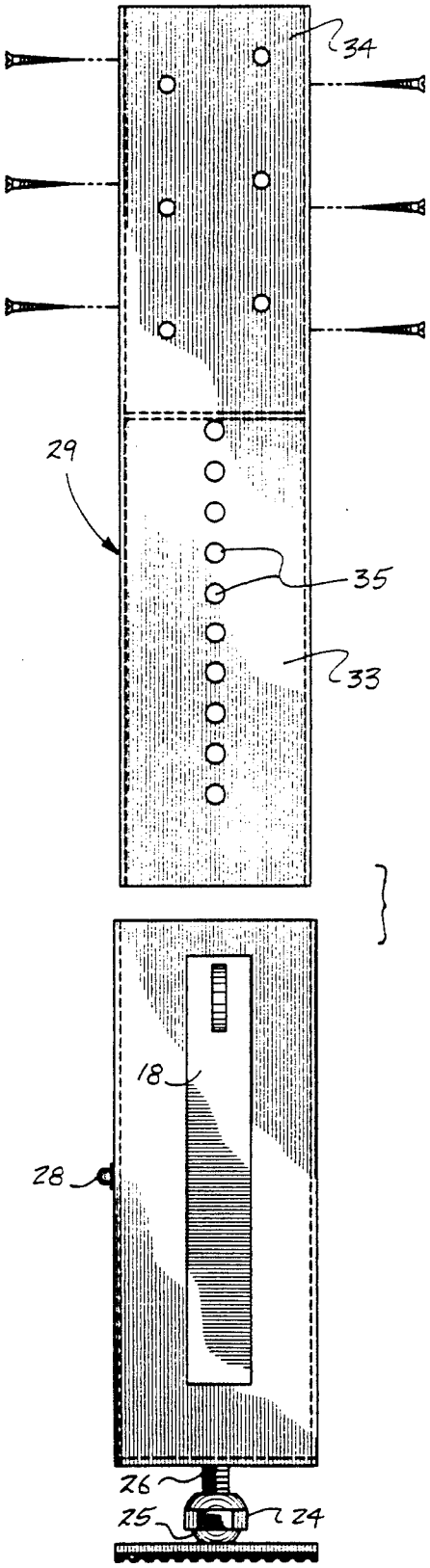
FIG. 9 is an orthographic side view of the invention, as indicated in FIG. 8.

The FIGS. 8 and 9 indicate the optional and further use of a junction sleeve 29 receiving a lowermost end of a ladder leg, such as the ladder leg 11, therewithin. The junction sleeve 29 includes respective first and second sockets 30 and 31 longitudinally aligned separated by a partition wall 32, with the first and second sockets 30 and 31 defined within respective upper and lower socket tubes 34 and 33 respectively. As the ladder leg is fixedly mounted within the first socket 30, the second socket 31 is arranged to be received within the leg sleeve 13 and to this end, lower tube bores 35 are directed through the side walls of the lower socket tube 33 for receiving the lock pin 20. As indicated in the FIG. 8 for example and in the FIGS. 6 and 7, if desired, a further lock pin **20*a* having a further handle 21*a* is longitudinally aligned with the lock pin 20 such that the further lock pin 20*a* is mounted to a further spring plate 18*a*, in a manner as indicated relative to the spring plate 18**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ladder leg extension apparatus, comprising in combination with a ladder, wherein said ladder includes a first ladder leg and a second ladder leg, each of a predetermined length, and at least said first ladder leg includes a lower distal end, and a leg sleeve having sleeve bores arranged to telescopingly position the lower distal end relative to the leg sleeve, the leg sleeve including a leg sleeve floor, spaced leg sleeve side walls, and a pivot head mounted relative to the floor, having a resilient bottom wall laminate spaced from the floor, and a spring plate, the spring plate having a spring plate first end and a spring plate second end, the spring plate first end including an anchor lug, wherein the anchor lug is secured to one of said side walls, and the spring plate second end including a lock pin fixedly and orthogonally mounted to the spring plate, wherein the lock pin is received through one of said sleeve bores, and a further spring plate, with the further spring plate including a further spring plate first end having a further spring plate anchor lug secured to the leg sleeve, with the further spring plate having a further spring plate lock pin received through a further of said sleeve bores, and a foot member includes a spherical connector member fixedly mounted to the foot member, and a semi-spherical housing mounted relative to the floor, wherein the spherical connector member is rotatably mounted within the semi-spherical housing, and a threaded adjuster rod integrally mounted to the semi-spherical housing, with the threaded adjuster rod threadedly received through the floor to adjustably position the foot member relative to the floor, and a spirit level mounted to one of said end walls, and a junction sleeve receiving said ladder leg, wherein the junction sleeve includes a lower socket tube and an upper socket tube longitudinally aligned, with a partition wall positioned intermediate the lower socket tube and the upper socket tube, the upper socket tube having a first socket, the lower socket tube having a second socket, with the first socket receiving said ladder leg, and the second socket received within said leg sleeve, and the lower socket including a row of lower tube bores, wherein one of said lower tube bores is aligned with said sleeve bores.

* * * * *